US006996966B2

(12) United States Patent
Badiali et al.

(10) Patent No.: US 6,996,966 B2
(45) Date of Patent: Feb. 14, 2006

(54) BLOCKING DEVICE OF THE UNWINDING OF THREADS FROM THE FEEDING BOBBINS OF A DOUBLE-TORQUE TWISTER

(75) Inventors: Roberto Badiali, Pordenone (IT); Ruggero Nicodemo, Casarsa (IT); Giovanni Ghinami, Fiume Veneto (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 0 days.

(21) Appl. No.: 11/050,935

(22) Filed: Feb. 4, 2005

(65) Prior Publication Data

US 2005/0199762 A1 Sep. 15, 2005

(30) Foreign Application Priority Data

Feb. 9, 2004 (IT) ..... MI2004A0201

(51) Int. Cl.
*D01H 1/10* (2006.01)

(52) U.S. Cl. ..... 57/58.55; 57/58.83

(58) Field of Classification Search ..... 57/78, 57/88, 58.54, 58.55, 58.7, 58.83
See application file for complete search history.

(56) References Cited

U.S. PATENT DOCUMENTS

| | | | | |
|---|---|---|---|---|
| 4,930,301 | A * | 6/1990 | Kawarabashi | 57/80 |
| 5,220,777 | A * | 6/1993 | Badiali et al. | 57/279 |
| 5,291,729 | A * | 3/1994 | Badiali et al. | 57/279 |
| 2002/0000084 | A1 * | 1/2002 | Scheufeld | 57/58.83 |

* cited by examiner

*Primary Examiner*—Gary L. Welch
*Assistant Examiner*—Shaun R. Hurley
(74) *Attorney, Agent, or Firm*—Hedman & Costigan, P.C.

(57) ABSTRACT

Blocking device of the unwinding of the threads from the feeding bobbins of a twisting spindle with superimposed bobbins inserted on their hollow pin, in which the threads are blocked with mechanical interceptors brought into their unwinding range at the entrance of the respective hollow pins and activated by means of sensors of the twisted thread situated downstream of the thread-guide curl.

14 Claims, 8 Drawing Sheets

50
5
59
51
6
30
22
3
10
1
40
13
46
17
23
4
20
11
14
2
33

Fig. 2BIS
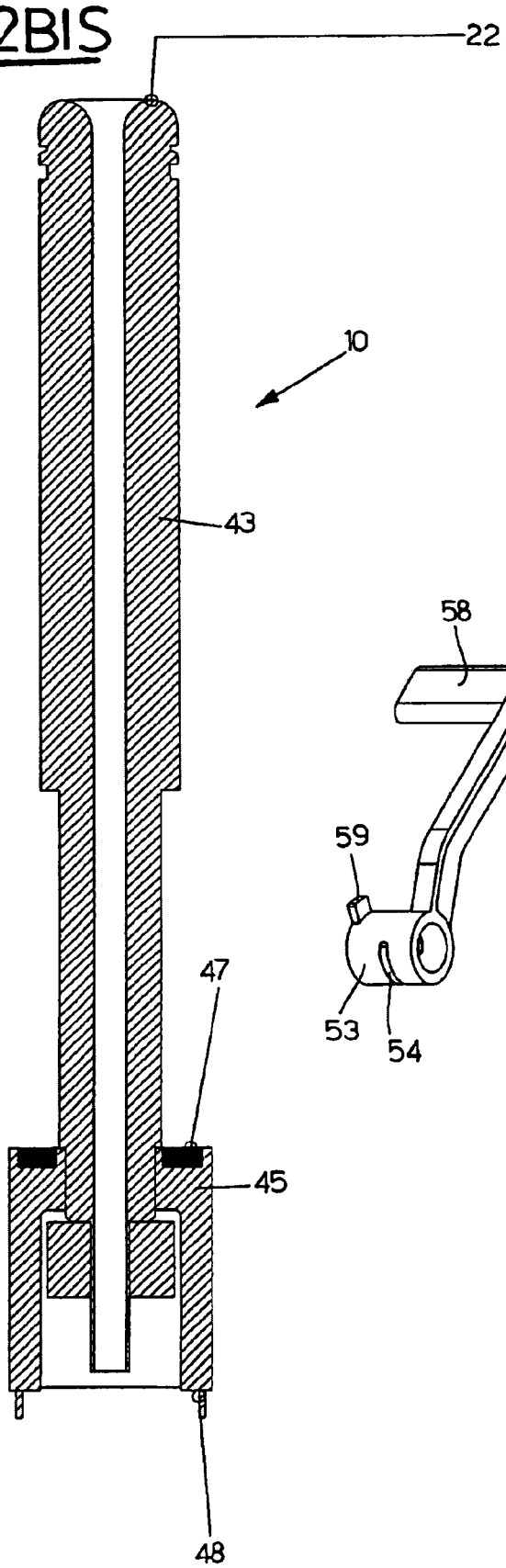
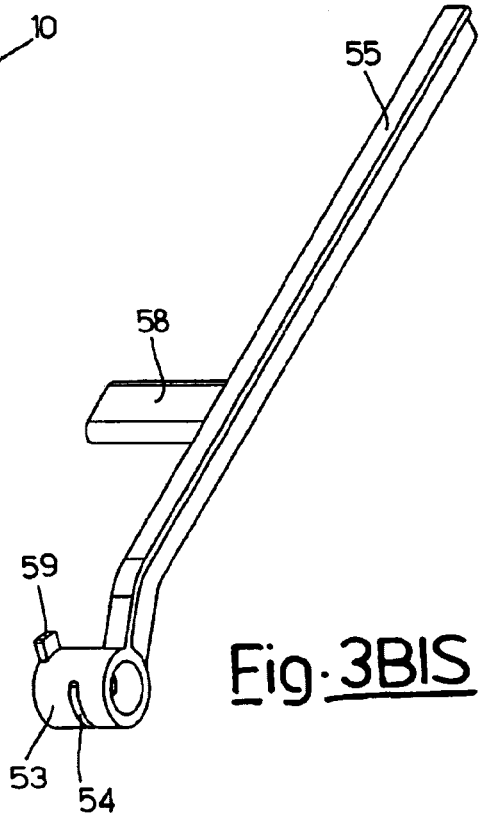
Fig. 3BIS

Fig. 2TER
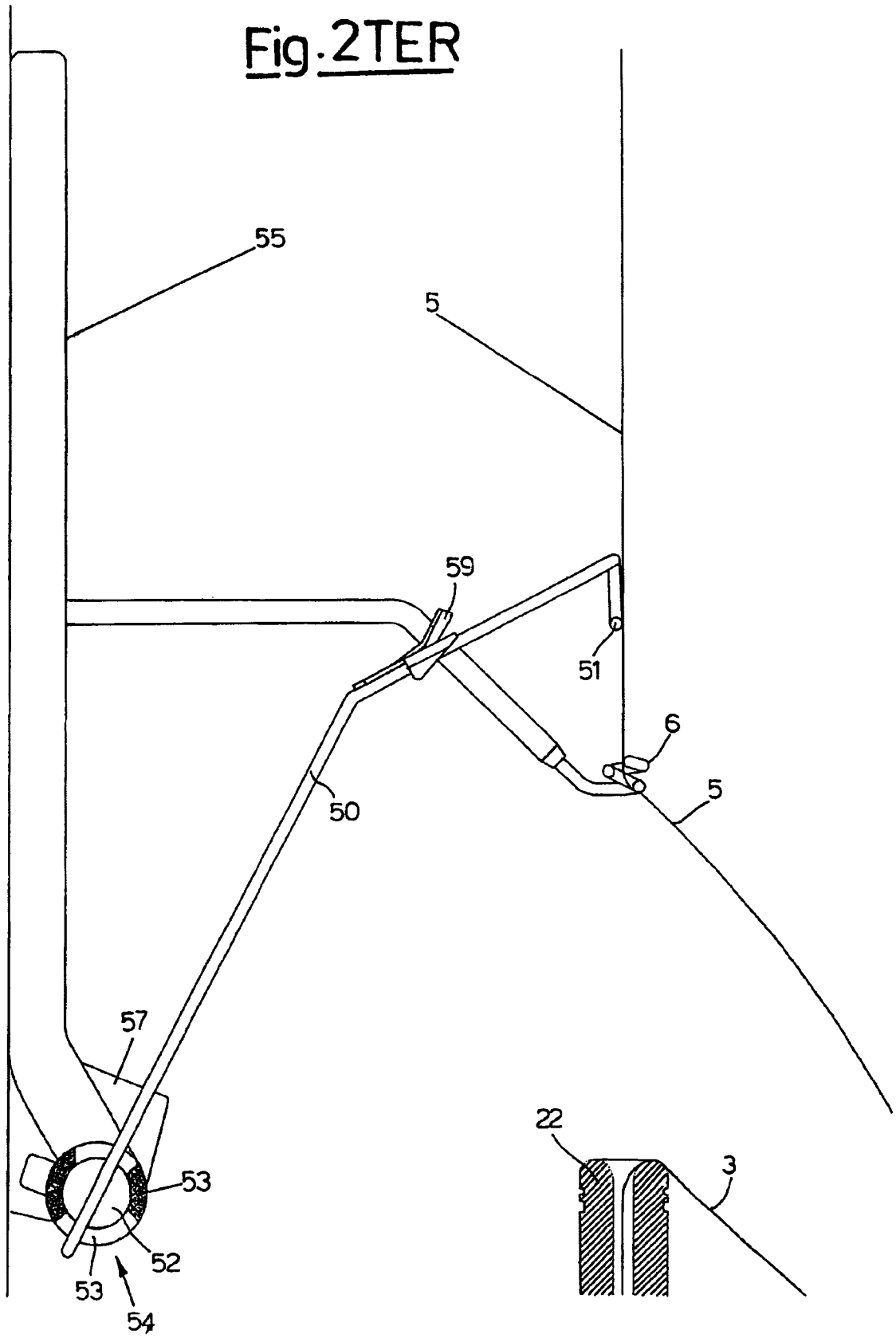

6
57
55
59
10
3
51
1
46
47
45
48
48
4
11
2

BLOCKING DEVICE OF THE UNWINDING OF THREADS FROM THE FEEDING BOBBINS OF A DOUBLE-TORQUE TWISTER

The present invention relates to double-torque twisting and more specifically to controlling the threads fed to the twister.

Twisting operations consist in joining two or more threads by their mutual twisting around their longitudinal axis, producing a new higher quality thread, more resistant to traction and abrasion, more regular and with an improved appearance and feel.

Twisting can be effected by feeding the two or more threads already coupled and wound parallelly by an assembler, or—according to an industrially more advanced technology—by taking the single threads from two separate bobbins, generally conical and superimposed. The present invention can be advantageously applied in this latter type of twisting, carried out starting from two bobbins of thread without the intermediate stage of assembling or coupling in an assembler.

For a better understanding of the technical problems relating to twisting, and of the characteristics and advantages of the technical solution according to the present invention, it is described herein with reference to a twister fed with separate threads from two superimposed bobbins of the type already object of the previous patents EP-B1-417,850 and EP-B1-528,464 of the same applicant, which respectively relate to the double hollow pin and the alignment process of the two threads at the start of the twisting operation in one of the twister units. These patents provide greater details on the twister as a whole.

Figure 1:
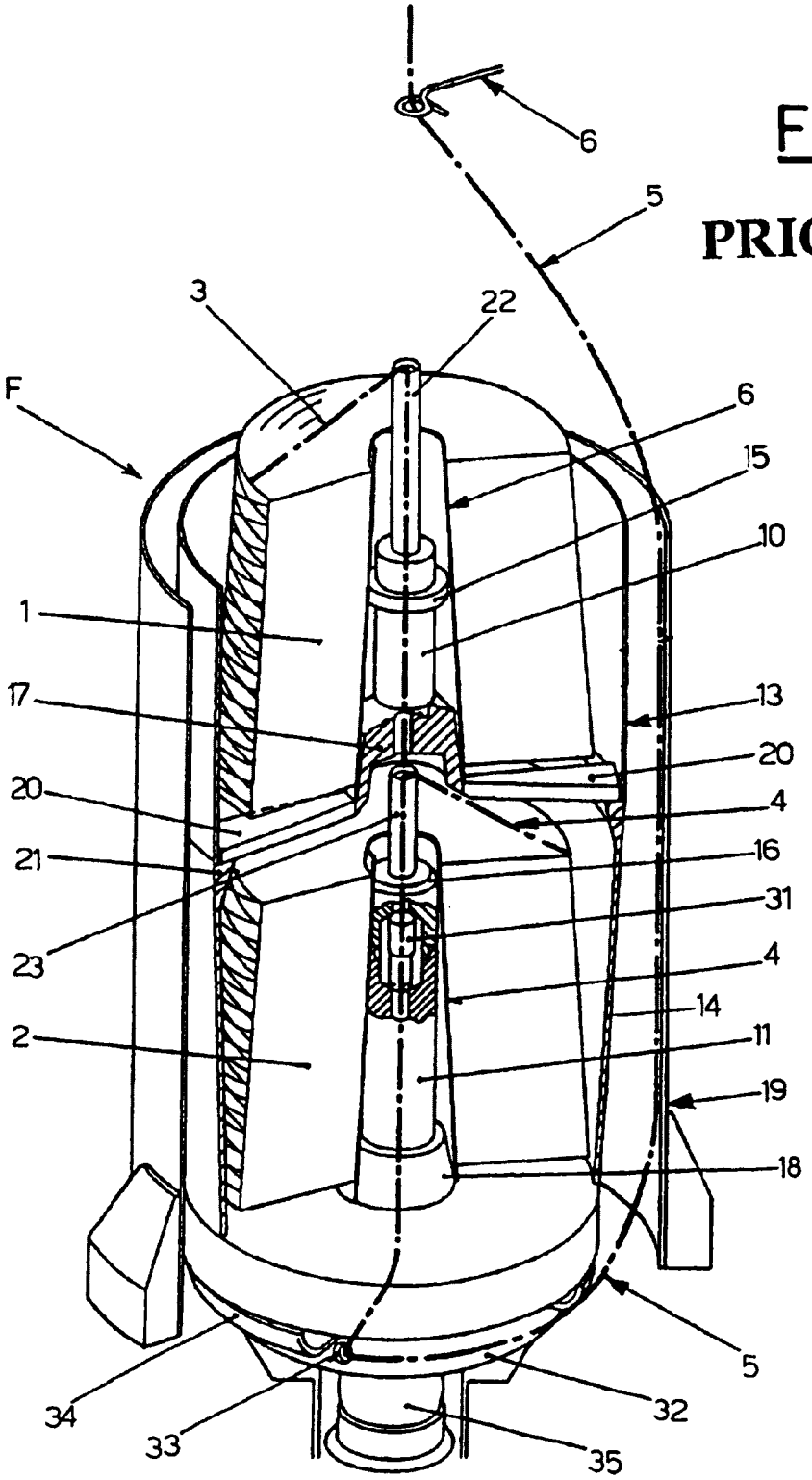
Fig.1 PRIOR ART

In order to illustrate the problems and technical solutions associated with double-torque twisting, the conventional scheme of a twisting station is schematically described, with reference to FIG. 1, bearing in mind that, in general, double-torque twisters consist of a series of twisting stations situated abreast of each other forming the front of the machine.

FIG. 1 refers to the scheme of a twisting spindle F already known according to the patent EP 417,850 filed by the same applicant: this shows two conical superimposed bobbins 1 and 2 which feed the twisting with single threads.

The feeding is provided by the upper feeding bobbin 1 and the lower feeding bobbin 2 with the threads 3 and 4 respectively, which form a double twisted thread 5 which forms the twisting product. The twisted thread 5 passes through a thread-guide ring 6 and moves towards the collecting bobbin of the twisted thread produced which, for the sake of simplicity, is not illustrated. The rotation rate of said bobbin is kept constant and creates the linear unwinding rate of the underlying feeding bobbins 1 and 2. The production rate is in the order of magnitude of tens of linear metres of twisted thread per minute.

The truncated-conical bobbins 1 and 2 have the conical section facing upwards, they are centered by hollow, superimposed pins, 10 and 11 respectively, forming the core of the twisting spindle and are contained in two baskets 13, 14 respectively. The pins 10 and 11 have circumferential enlargements 15, 16 which, together with the lower hubs 17 and 18, act as supporting and centering elements of the unwinding bobbins 1 and 2, or more specifically, their spools 1' and 2' respectively. The twisting station is contained in an outer casing 19 currently called balloon container.

The upper hub 17 is sustained with radial supporting elements 20 which are connected with the basket 13. A suitable bulging 21 of the upper edge of the underlying basket 14 serves to sustain and center the upper basket 13.

At the top 22, 23 of each of the two superimposed and coaxial pins 10 and 11 which form the core of the twisting spindle, the two threads 3 and 4 then enter the cavity of the respective pins 10 and 11 and pass through this together as far as the foot of the twisting station where they meet a tensioning device 31 inside the spindle, already known in the art, described, for example, in the previous patent EP 528,464 filed by the same applicant.

At the foot of the twisting station there is a rotating disk 32 equipped with a radial duct 33 from which the double thread 5 exits and an edge 34 which guides the thread after its exit.

The rotating disk 32 is the only part activated in movement of the twisting spindle F and is made to rotate with the pulley 35, which is activated by tangential transmission with a longitudinal activating belt common to all the stations F situated on the front of the twister, not shown in the figure, for the sake of simplicity.

In the twisting spindle F so far illustrated, each thread 3, 4 is unwound from its bobbin 1, 2 and the most frequent anomalies derive from breakage of the threads. If the twisted thread 5 breaks, its collection is naturally interrupted, whereas if only one of the threads 1, 2 being fed, break, it is possible for the collecting to continue with the remaining thread alone.

In both cases, if the spindle F continues to rotate, there is the possibility that only one or both of the threads being fed can continue to unwind. The quantity of thread unwound from the bobbins 1, 2 and not twisted with the thread wound onto the upper collecting bobbin, is wound inside the spindle itself, breaks and becomes disaggregated, causing a waste of useful material and creating isolated segments and dust which is harmful for the machine. The thread, which is no longer controlled, can interfere with and wind itself onto the activation organs.

The removal of this material on the part of the operator requires most of the intervention time necessary for re-establishing the operating conditions of the twisting unit.

When the spindle is functioning, whereas it is easy to reach the thread 3 and the upper bobbin 1 and consequently interrupt their unwinding, a direct intervention due to blockage of the unwinding of the thread 4 is not easy as a result of the difficulty of reaching the space between the two bobbins 1, 2.

In the known art, further unwinding of the threads is generally indirectly prevented by stopping the twisting station F. This stoppage is effected by stopping the rotation of the spindle, thus preventing the threads from being pulled back from the bobbins due the centrifugal force of the spindle itself, and at the same time by lowering a feeler of the twisted thread which is situated above the upper bobbin, in the ascending area of the balloon, so as to interfere with the rising threads, preventing them from being collected.

The descent of the twisted thread feeler—a technique which is already known—can take place naturally either by the absence or breakage of the twisted thread itself, or when the feeding has been reduced to a single thread which is untwisted, and therefore weakened, in the first part of its run and is not capable of resisting the stress of the feeler. The descent of the twisted thread feeler can also be caused by a specific actuator—either mechanical or pneumatic—following the detection of an anomaly of the characteristics of the twisted thread which is entrusted to a sensor situated on the collection path, for example with respect to tension, torque distribution, presence of undesired defects.

The braking of the spindle F—a technique which is already known—requires a costly complication of the device as it generally requires the following operations, in sequence:

detaching the tangential entrainment belt from the pulley 35, braking the spindle F with an individual shoe brake on each spindle, keeping the spindle F and the belt detached until after the intervention of the operator.

The whole operation is difficult, and especially for tangential transmission machines, as there is considerable stress in detaching the belt, which causes an increase in the tension of the belt with a consequent overloading of the mechanical organs. This overload is particularly dangerous when intervening on several twisting spindles F, for example in the lifting operation when all the spindles have been stopped.

The objective of the present invention is to provide a blocking device of both of the feeding threads to the twisting spindle F, which overcomes the drawbacks of the available blocking systems of the known art.

This objective is achieved according to the present invention with a direct blocking device of the feeding of the threads without the necessity of stopping the twisting spindle.

The most important characteristics of the blocking device of the feeding threads to the twister are defined in the dependent claim, whereas preferential embodiments are defined in the dependent claims.

The invention is described hereunder with reference to some embodiments shown in FIGS. 2 to 6, for purely illustrative but non-limiting purposes, and to clarify the characteristics and advantages of the present invention referring to the enclosed schematic drawings.

FIG. 1 shows a perspective view of the twisting spindle F of a twisting station with the superimposed two feeding bobbins to illustrate the technical problem faced in the present invention.

Figure 2:
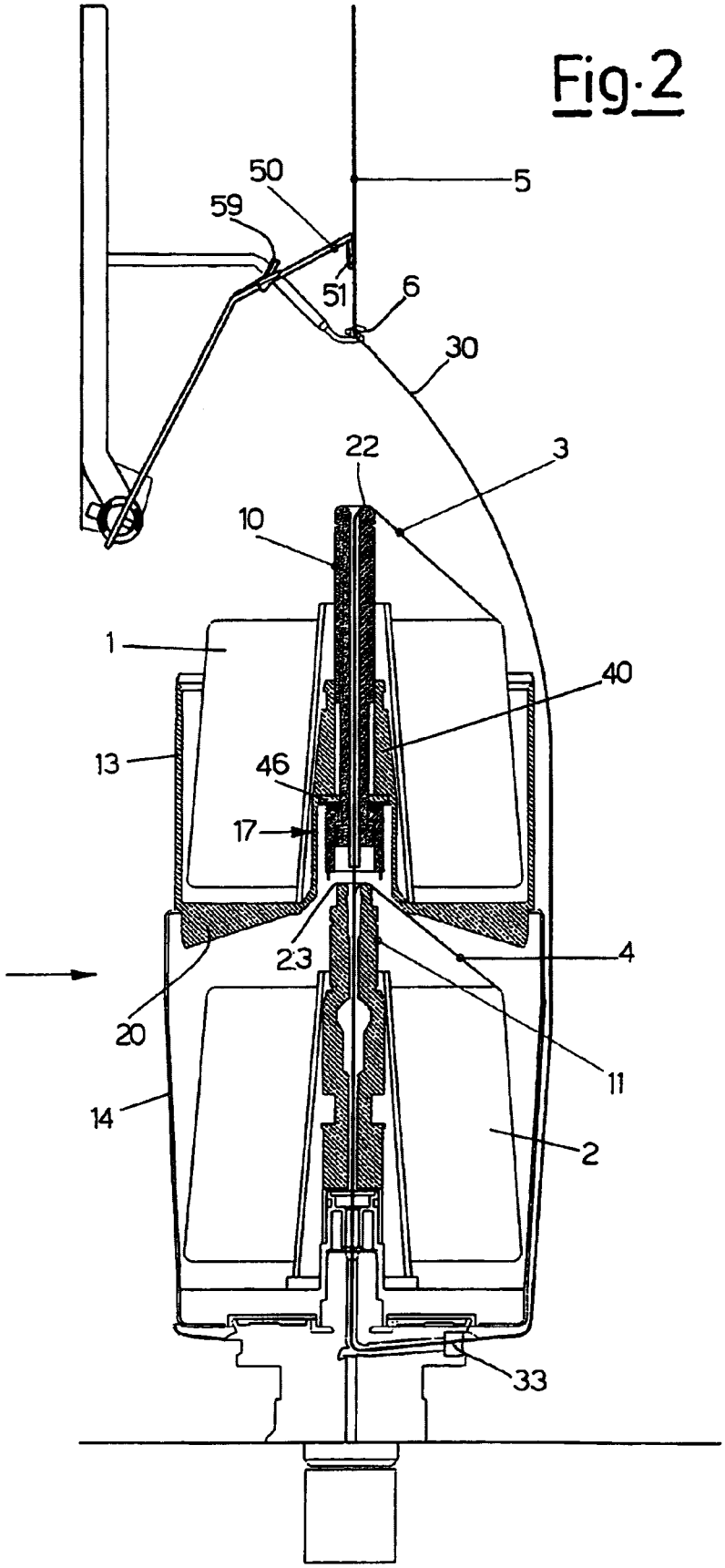

FIG. 2 illustrates the configuration of the twisting station in the normal operating phases with free unwinding of the two feeding bobbins. FIG. 2*bis* shows, as an enlarged detail, the conformation of the upper hollow pin 10. FIG. 2*ter* shows, as an enlarged detail, the conformation and functioning of the thread feeler 50 and organs connected therewith.

Figure 3:
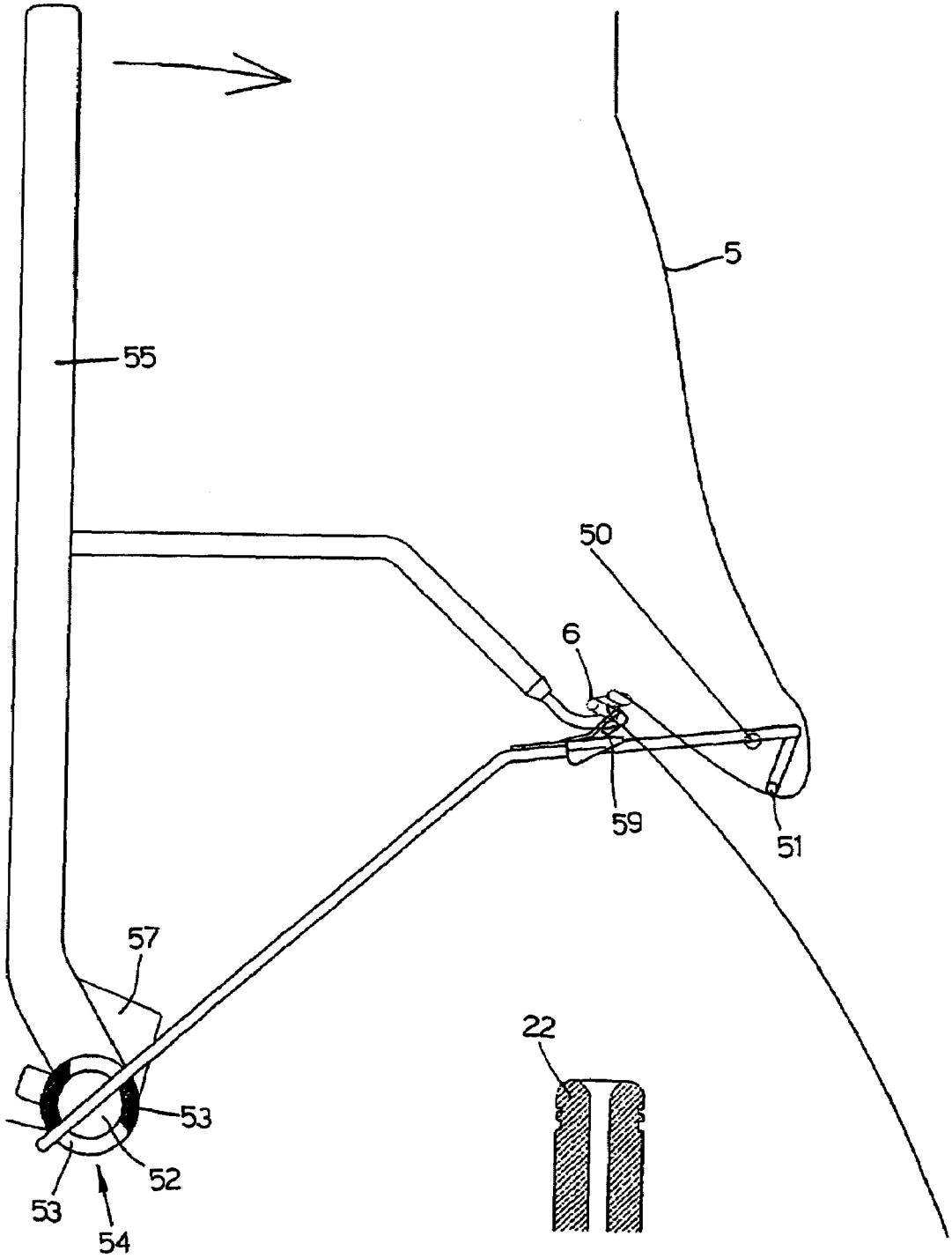

FIG. 3 illustrates the behaviour of the thread feeler 50 in the presence of broken thread, absent or faulty, and 3*bis* the conformation of the arm 55.

Figure 4:
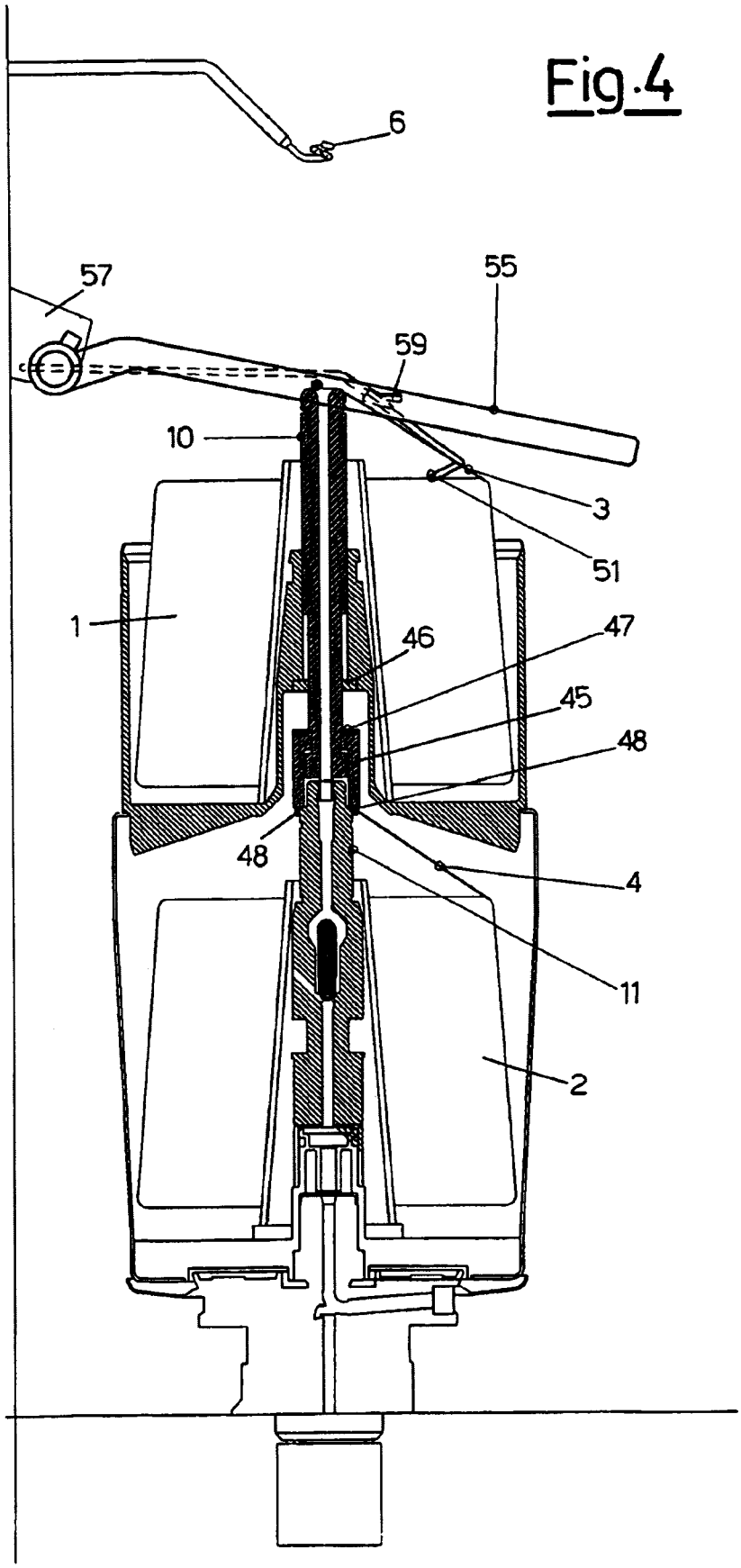

FIG. 4, on the other hand, illustrates the configuration of the twisting station with the breakage of one or more of the threads with the blocking of their unwinding from the two feeding bobbins.

Figure 5:
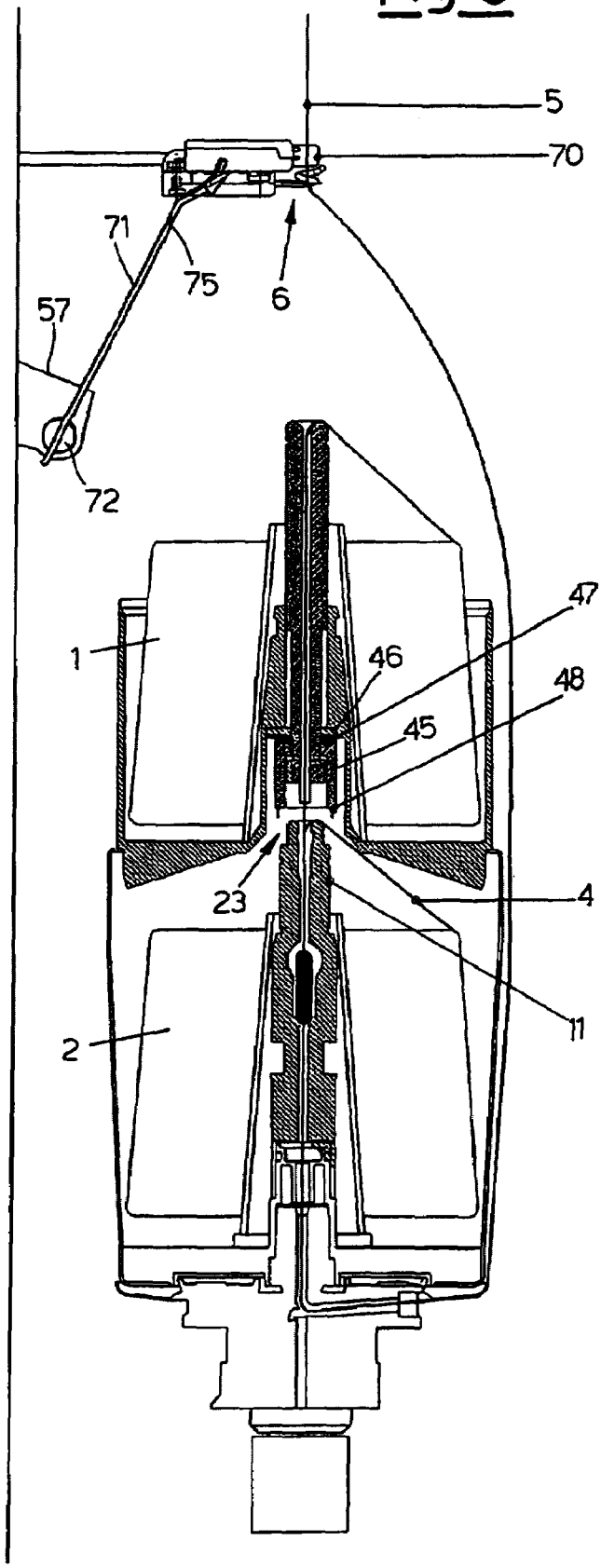
Figure 6:
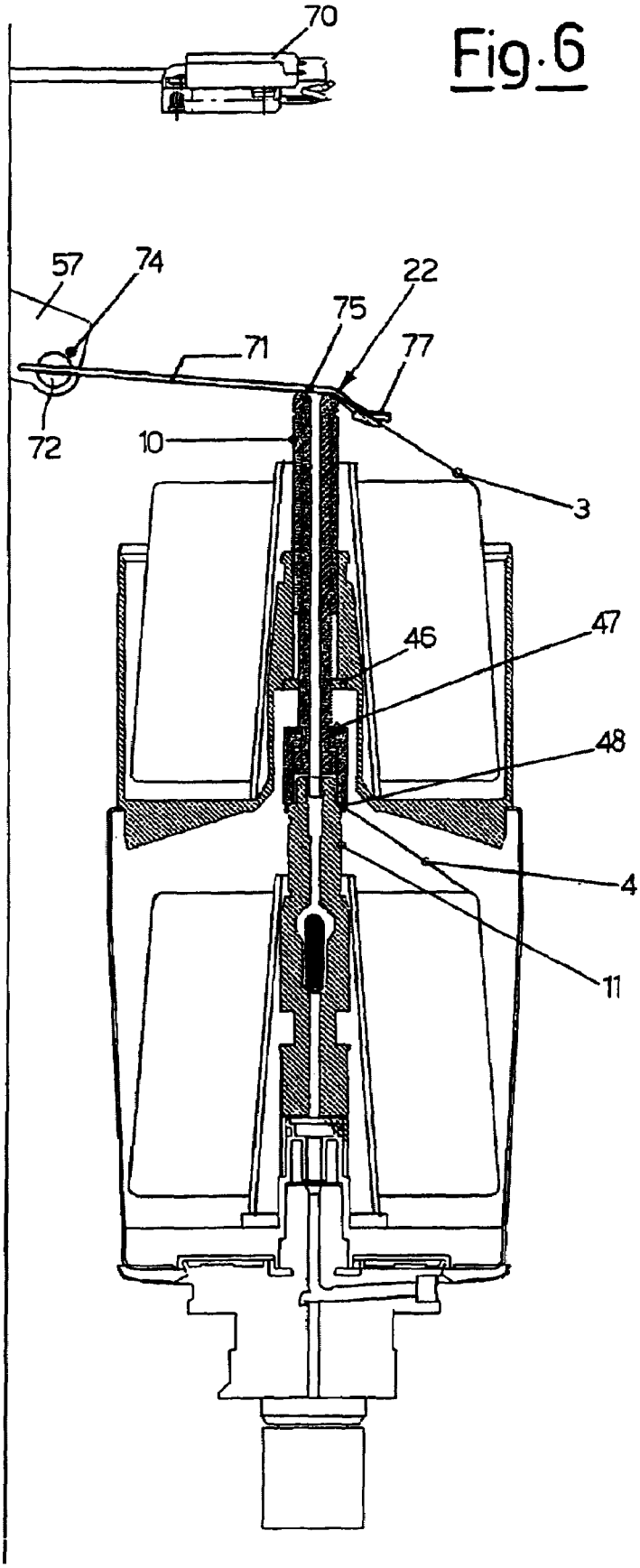

FIGS. 5 and 6 show an alternative embodiment of the invention; these respectively illustrate the configuration of the twisting station during normal functioning and its configuration when an irregularity of the thread 5 occurs, by blockage of the unwinding of the threads from the two feeding bobbins.

FIG. 2 illustrates the normal functioning of the twisting station. The feeding consists of two threads 3 and 4, coming from the feeding bobbins 1, 2 situated in the cylindrical baskets 13, 14, which are each inserted in their unwinding head, consisting of the upper ends 22, 23 of the superimposed pins 10, 11, they pass through their cavities in series and are twisted in the low part of the spindle F; the double twisted thread 5 then rises outwardly and upwards where it is collected.

The two threads 3, 4 unwind at the pulling rate of the twisted thread, spinning around their bobbin and penetrating the tops of their hollow pins 10, 11. In order to limit wear phenomena due to the running of the thread, these pin tops are protected with smooth rounded metal washers.

The double twisted thread 5 leaves the hole 33 of the rotating disk 30 spinning rapidly; its balloon is controlled first by the internal wall of the containment cylinder 19 and then by the thread-guide curl 6; it is drawn by the pulling exerted by the upper winding bobbin. Said collection bobbin of the twisted thread 5 is not shown in the figure for the sake of simplicity. It follows, for example, the known conventional scheme of a bobbin-holder arm which carries the bobbin, where the twisted thread is wound onto its tube; it is made to rotate by contact with an activation cylinder which rotates at a constant rate and which creates the constant pulling rate of the twisted thread 5, starting from the two feeding bobbins 1, 2.

As illustrated in FIG. 2, where it is shown in a longitudinal section, the supporting structure of the upper bobbin 1 and the upper hollow pin 10 essentially consists of the upper basket 13, the radial supporting elements 20 on the container basket 14, the centering pin 17 and its upper truncated-conical part 40, which are integral with each other.

The upper hollow pin 10 is kept in a raised upward position and axially separated with respect to the lower hollow pin 11. In the known art, this raising and axial distancing action of the upper hollow pin 10 with respect to the lower hollow pin is normally entrusted to a coaxial spring system inserted between said upper hollow pin and the inside of the fixed centering pin 17.

In the illustrative embodiment of FIGS. 2, 2*bis* and 3, the truncated-conical part 40 corresponds to a cylindrical cavity 41 coaxial with the hollow pin 10, thus forming a cylindrical guide of the hollow pin 10 in its axial ranges. Analogously, the hollow pin 10 corresponds to an upper cylindrical part 43, with a coherent dimension for its guided running from inside the hollow 41, and with a lower larger hood-shaped cylindrical part 45, as illustrated further on. This cylindrical part 45 has radial dimensions which allow it to run inside the lower cavity of the truncated-conical part 40, enabling the upper part of its hood 45 to rest on the bottom of the lower cavity of the truncated-conical part 40.

The conventional coaxial spring lifting system can therefore be inserted into the cavity 41 around the cylindrical part 43.

According to a preferred embodiment of the invention, these parts are produced in a form coherent with one another so that, at the run end, they can adhere to each other. Of the parts which are thus in contact, one is produced with ferromagnetic characteristics, for example by producing it with ferrous material or inserts, for example an iron washer 46 integral with the truncated-conical part 40, and a permanent magnet 47 is inserted in the other part. Once contact has been established and the hollow pin 10 has reached its upper run end, the washer 46 and magnet 47 are at a minimum distance and the magnetic attraction has its maximum value. The possible variations in the tension of unwound thread are consequently opposed by the magnetic force which withholds the pin at its run end without harmful vibrations.

This maintenance system in a raised position of the upper hollow pin 10 can also be effected without coaxial springs. In this case, once the lowering of the upper hollow pin has been completed, its re-lifting must be effected by the operator who intervenes on the twisting station, until the hood 45 and magnet 47 have been brought back to their upper run end.

As shown in FIG. 2*bis*, the hollow pin 10 is produced in several coaxial threaded parts to allow it to be introduced into its cylindrical guide consisting of the cavity 41 of the truncated-conical part 40. Various elements 48, protruding downwards, are situated at the bottom of the hooded element 45, which guide the thread when the hollow pin 10 is lowered against the top of the lower hollow pin 11.

As illustrated in FIG. 2, the twisted thread 5 rises upwards in the cylindrical space between the outer casing 19—no longer shown in the drawing, for the sake of simplicity—and the two baskets 13, 14, which contain the two feeding bobbins, and passes through the threadguide ring 6. Above the thread-guide 6, the thread encounters the thread-feeler 50, consisting of a lever hinged onto the structure of the twisting station and whose terminal part 51 rests on the thread running upwards.

FIG. 2*ter* shows an enlarged view of the thread-feeler 50 and organs connected therewith. In the embodiment illustrated, the thread-guide lever 50 has an interrupted run and ends with a contact element 51 with the twisted thread, consisting of a rod orthogonal to the direction of the thread. The thread-feeler 50 is integral with a pin 52 which rotates inside a short tube 53 equipped with radial openings 54 which allow a certain free rotation with respect to the thread-feeler lever 50. The short tube 53 is, in turn, part of a mobile arm rod 55 hinged onto the fixed structure 57, and capable of coaxially rotating with the thread-feeler lever 50. During normal functioning, the arm 55 is in an almost vertical position and leaning backwards, so that its barycentre is pulled slightly back towards the left with respect to the rotation axis of the short tube 53, which is, in turn, hinged onto the element 57 of the fixed structure of the machine.

FIG. 3 shows the behaviour of the thread-feeler 50 when the thread 5, broken, absent or faulty, no longer sustains said thread-feeler, which is consequently lowered, rotating around its hinge in the short tube 53. In its initial rotation, the lever of the thread-feeler 50 rotates inside the openings 54 until it comes to a rest with its shoulders which delimit the openings 54 and, with its weight, engages and also forces the short tube 53 to rotate, thus causing the arm 55 to drop, making its barycentre rotate in a clockwise direction around the short tube 53 according to the arrow of FIG. 3.

The detail of FIG. 3*bis* shows the conformation of the arm 55, in a perspective view. The body of the arm 55 is produced with a draw piece and is hinged in a terminal part to the fixed structure 57 with the short tube 53, which, in turn, also contains and guides the thread-guide 50.

The body of the arm 55 is produced with a weight which is sufficient to press the upper hollow pin 10, overcoming the elastic and/or magnetic forces which keep it lifted, making it drop until it rests on the top of the lower hollow pin 11. A transversal supporting element 58 is inserted, in the body of the arm 55, on the top 22 of the upper hollow pin 10. A nib 59 is also inserted on the short tube 53, which established the run end of the rotation of the arm 55 against shoulder elements, not shown in the figure for the sake of simplicity.

The configuration of the thread-feeler 50 and arm 55, coupled with the rotation pin 52 which rotates inside the short tube 53 with openings 54, causes a certain preestablished delay between the breakage and/or lack of thread 5 and the falling of the arm 55 to interrupt the unwinding of the threads 3, 4 from their feeding bobbins.

FIG. 4 illustrates the configuration of the twisting station following the falling of the thread-feeler 50 and arm 55, following breakage or lack of twisted thread 5, for activating the blockage of the unwinding of the two feeding bobbins.

The falling of the feeler 50 of the thread 5 takes place in a clockwise direction at one of its run ends, not shown in the figure for the sake of simplicity. On its rear part, the feeler 50 is equipped with an interception and interruption element 59 of the thread 3 unwound from the upper bobbin 1 which prevents it from being pulled back again inside the upper hollow pin 10.

The further unwinding of the feeding thread 3 from the upper bobbin is blocked by a mechanical intercepting device 59 which enters its unwinding range, interrupts it and prevents it from continuing to pass into the upper hollow pin 10.

With a small delay with respect to the feeler (50), the arm 55 also begins to fall until its weight rests with the transversal element 58 on the top 22 of the upper hollow pin 10. The impact of the arm 55 causes, in turn, the disinsertion of the upper hollow pin 10 from the elements which are keeping it lifted, for example the magnet 47, and lowers it until its hooded element 45 reaches the top 23 of the lower hollow pin 11.

The connection elements 48 situated at the end of the hooded element 45 intercept the thread 4 when the hollow pin 10 reaches the top of the lower hollow pin 11 and prevent it from further unwound from its bobbin 2 and pulled back again inside the upper hollow pin 10.

The unwinding of the feeding thread 4 from the lower bobbin 2 is thus blocked by the downward activation of a mechanical intercepting device 48 which enters the unwinding field of the thread 4 and prevents it from passing into the lower hollow pin 11.

In the alternative embodiment of the invention illustrated in FIG. 5, the rising thread 5, after passing the thread-guide 6, runs past a thread-anomaly sensor 70, capable of detecting whether the thread is present and running, and also if it falls within a range of preestablished titer and regularity characteristics. When the sensor 70 detects the lack of running thread or an anomaly in the characteristics of the thread, it causes the falling of an arm 71 whose function is analogous to that of the arm 55 of the embodiment illustrated in the previous figures. It is hinged with a pin 72 which rotates inside a cylindrical housing situated in the fixed structure 57 and is capable of falling between an upper position, shown in FIG. 5, to a lower position, shown in FIG. 6. The arm 71 is sustained in the upper position by a supporting element 74 having two alternative controlled positions: a protruding advance position to support the resting arm 71 and a backward position unhooking the falling arm 71 until it reaches the upper hollow pin 10. These two positions are controlled according to the detections of the sensor 70: anomalies or the absence of thread cause the withdrawal of the element 74 and the falling of the arm 71, whereas the detection of the presence of thread, running normally, keeps the element 74 in an advanced supporting position of the arm 71.

For this purpose, a transversal pin 75 is inserted in the body of the arm 71 as a rest on the top 21 of the upper hollow pin 10, when it drops for the withdrawal of the element 74. The arm 71 is also produced with a weight which is sufficient for pressing the upper hollow pin 10, overcoming the elastic and/or magnetic forces, which keep it raised. The arm 71 is equipped in its end part with a thread interception and interruption element 77.

FIG. 6 illustrates the configuration of the twisting station illustrated in FIG. 5 following the detection of an anomaly of the thread on the part of the sensor 70. The falling of the arm 71 following the detection of the sensor 70 of anomalies or lack of twisted thread 5, causes blockage of the unwinding of the two feeding bobbins.

As it falls, the arm 71 intersects, with the thread cutting element 77, the pointed surface according to which the balloon rotates during normal twisting functioning. If the sensor 70 has detected an anomaly of the twisted thread 5, the falling of the arm 71 also causes interruption of the thread.

When the arm 71 arrives at the top 22 of the upper hollow in 10, the element 77 also intersects the run of the thread 3 unwound from the upper bobbin 1 and interrupts it, preventing it from being pulled back into the upper hollow pin 10. The arm 71 contemporaneously rests its weight with the transversal element 75 on the top 22 of the upper hollow pin 10, lowers it and also interrupts the feeding from the lower bobbin, analogously to what is described with reference to FIG. 4.

The thread blocking device according to the present invention allows considerable advantages with respect to the known art. The fact that the blocking of the unwinding of the threads 3, 4 from the feeding bobbins 1, 2 takes place without requiring the braking and stoppage of the spindle, is immediately evident.

It can also be noted that, in the known art, the blocking of the unwinding from the lower bobbin with the spindle functioning was prevented due to the difficulty in reaching the space between the two bobbins.

Individual braking automatisms for each twisting spindle are not necessary, with considerable simplification and economy.

The invention claimed is:

1. A blocking device of the unwinding of threads (3, 4) from the feeding bobbins (1, 2) of a twisting spindle (F) with coaxially superimposed bobbins inserted on their own hollow pin (10, 11), each thread (3, 4) unwinding upwards from its bobbin and in the same direction as the other thread, directly entering the hollow pin (10, 11) without penetrating, during its run, the space surrounding the other bobbin, characterized in that the blocking device of the unwinding of the thread (4) of the lower bobbin (2) comprises a mechanical interceptor (48) integral with the upper hollow pin (10), activated with means for activating (55, 71) for its descent to enter into the unwinding range of the thread (4) preventing it from passing into the lower hollow pin (11).

2. The blocking device of the unwinding of threads according to claim 1, characterized in that the blocking device of the unwinding of the thread (4) of the lower bobbin (2) is associated in coordination with the blocking device of the unwinding of the thread (3) of the upper bobbin (1) consisting of a mechanical interceptor (59, 77) which enters the unwinding range and interrupts it, preventing the thread from passing into the upper hollow pin (10).

3. The blocking device of the unwinding of threads according to claim 2, characterized in that the activation of the blocking means of the unwinding of the feeding threads (3, 4) is controlled by the falling from a mechanical thread-feeler (50) of the twisted thread (5) situated downstream of the thread-guide curl (6).

4. The blocking device of the unwinding of threads according to claim 2, characterized in that the activation of the blocking means of the unwinding of the feeding threads (3, 4) is controlled by a sensor (70) of anomalies of the twisted thread (5).

5. The blocking device of the unwinding of threads according to claim 4, characterized in that the sensor (70) of anomalies of the twisted thread (5) is capable of detecting whether said thread is present and running and also if it falls within a range of pre-established titer and regularity characteristics.

6. The blocking device of the unwinding of threads according to claim 1, characterized in that the blocking device of the unwinding of the thread (4) of the lower bobbin (2) consists of one or more elements (48) protruding downwards, situated at the bottom of the hooded element (45), which forms the lower terminal part of the upper hollow pin (10), which guide the thread when the hollow pin 10 is lowered against the top of the lower hollow pin (11).

7. The blocking device of the unwinding of threads according to claim 6, characterized in that the upper hollow pin (10) is produced in several coaxial threaded parts.

8. The blocking device of the unwinding of threads according to claim 1, characterized in that the system for keeping the upper hollow pin (10) in a raised position with respect to its hub (17) is of the magnetic type, one part being constructed with ferrous material or inserts and inserting a magnet (47) in the other part.

9. The blocking device of the unwinding of threads according to claim 3, characterized in that the activation of the blocking means of the unwinding of the threads (3, 4) is effected with mechanical coupling in rotation of a thread-feeler (50) and an arm (55) which, on falling, has a weight which is sufficient to press the upper hollow pin (10), overcoming the forces that keep it raised and making it drop until it reaches the top of the lower hollow pin (11).

10. The blocking device of the unwinding of threads according to claim 9, characterized in that the rotational coupling of the thread-feeler (50) and the arm (55), causes a pre-established delay between the breakage and/or absence of thread (5) and the falling of the arm (55) to interrupt the unwinding of the threads (3, 4) from their feeding bobbins (1, 2).

11. The blocking device of the unwinding of threads according to claim 4, characterized in that the activation of the blocking means of the unwinding of the threads (3, 4) is effected with the association of the sensor (70) and an arm (71), which the sensor causes to fall or keeps it in a raised position in relation to the thread detected, and the arm (71), on falling, has a weight which is sufficient to press the upper hollow pin (10), overcoming the forces that keep it raised and making it drop until it reaches the top of the lower hollow pin (11).

12. The blocking device of the unwinding of threads according to claim 11, characterized in that the arm (71) is maintained in an upper position by a supporting element (74) having two alternative controlled positions: an advance position by protruding to support the resting arm (71) and a reverse position which unhooks the arm (71) allowing it to fall until it reaches the upper hollow pin (10).

13. The blocking device of the unwinding of threads according to claim 11, characterized in that the arm (71) is equipped in its terminal part with an interception and interruption element (77) of the thread.

14. The blocking device of the unwinding of threads according to claim 13, characterized in that the arm (71) has a fall run in which it intersects, with the element (77), the surface according to which the balloon of twisted thread (5) rotates and also intersects the path of the thread (3) unwound from the upper bobbin (1).

* * * * *